United States Patent [19]

Bailey et al.

[11] 4,150,903

[45] Apr. 24, 1979

[54] TYPEWRITER-LIKE TOY

[75] Inventors: Charles E. Bailey, Lawndale; Sidney Bass, Los Angeles; Russell C. Edmisson, Manhattan Beach, all of Calif.

[73] Assignee: Mattel, Inc., Hawthorne, Calif.

[21] Appl. No.: 758,206

[22] Filed: Jan. 10, 1977

[51] Int. Cl.[2] ..... B41J 3/02

[52] U.S. Cl. ..... 400/95; 400/332; 400/422; 400/432; 400/452; 400/659; 400/694; 400/496

[58] Field of Search ..... 197/7, 13, 17, 22, 27, 197/28, 29, 32, 34, 35, 36, 53, 54, 60, 82, 86, 97, 98, 114, 122, 127 R, 144, 150, 176, 186 R, 18, 33, 47, 151

[56] References Cited

U.S. PATENT DOCUMENTS

| | | | |
|---|---|---|---|
| 447,773 | 3/1891 | Harnsberger | 197/7 |
| 457,088 | 8/1891 | Mariner | 197/114 R |
| 537,098 | 4/1895 | Yost | 197/86 |
| 606,814 | 7/1898 | Sears | 197/97 |
| 674,967 | 5/1901 | Green | 197/122 X |
| 966,170 | 8/1910 | Curtis | 197/28 X |
| 969,483 | 9/1910 | Knapp | 197/97 |
| 970,295 | 9/1910 | Beard | 197/150 X |
| 1,280,678 | 10/1918 | Clamecy | 197/127 R |
| 1,960,872 | 5/1934 | Grove | 197/17 |
| 2,188,935 | 2/1940 | Wittenmyer | 197/17 |
| 2,199,265 | 4/1940 | Lohrey | 197/36 X |
| 2,534,399 | 12/1950 | Berger | 197/47 |
| 2,545,375 | 3/1951 | Nunn | 197/27 X |
| 2,562,237 | 7/1951 | Julliard | 197/17 |
| 2,624,126 | 1/1953 | Bolognino et al. | 197/33 UX |
| 2,777,824 | 1/1957 | Leeds | 197/36 UX |
| 2,818,957 | 1/1958 | Brace | 197/27 |
| 2,862,592 | 12/1958 | Redmond | 197/36 |
| 3,006,061 | 10/1961 | Zahradnik | 197/144 X |
| 3,055,297 | 9/1962 | Leeds | 197/36 X |
| 3,057,449 | 10/1962 | Thomson | 197/22 |
| 3,209,682 | 10/1965 | Cooper et al. | 197/35 UX |
| 3,338,369 | 8/1967 | Rexford | 197/22 |
| 3,353,647 | 11/1967 | Hugel | 197/98 X |
| 3,387,694 | 6/1968 | Hagstrom | 197/98 |
| 3,578,136 | 5/1971 | Postal | 197/151 |
| 3,621,967 | 11/1971 | Brown | 197/18 |
| 3,633,723 | 1/1972 | Kosters | 197/98 X |

FOREIGN PATENT DOCUMENTS

| | | | |
|---|---|---|---|
| 758943 | 6/1953 | Fed. Rep. of Germany | 197/176 |
| 1027832 | 2/1953 | France | 197/22 |

OTHER PUBLICATIONS

IBM Technical Disclosure Bulletin "Pocket Printer", E.G. Nassimbene, Vol. 11 No. 11 Apr. 1969 pp. 1430–1431.

IBM Technical Disclosure Bulletin, "Porous Coating for Type Element", Bonafino et al., Vol. 15 No. 4 Sept. 1972, p. 1200.

IBM Technical Disclosure Bulletin, "Ink Flow Control Technique," Speicher, vol. 15, No. 5, Oct. 1972, pp. 1490–1491.

*Primary Examiner*—Ernest T. Wright, Jr.

*Attorney, Agent, or Firm*—John G. Mesaros; Max E. Shirk; Ronald M. Goldman

[57] ABSTRACT

A toy simulating a typewriter for enabling a child to compose a large number of sentences from a limited number of words, the toy having a keyboard with a plurality of keys, each key having a word imprinted thereon. A carriage is provided with paper receiving imprints of the words from hinged type arms operable upon depression of the keys, depression of one of the keys performing the imprinting operation and release of the key actuating a spacer frame coacting with an indexing bar for incrementing the carriage under force of a spring a predetermined distance.

10 Claims, 12 Drawing Figures

TYPEWRITER-LIKE TOY

BACKGROUND OF THE INVENTION

The background of the invention will be discussed in two parts:

1. Field of the Invention

This invention relates to toys and more particularly to a toy simulating a typewriter.

2. Description of the Prior Art

Toy typewriters have become very popular items with children however, toy typewriters in current usage are complicated, expensive and not readily usable by children of tender years who are generally unable to spell with any degree of precision. On the other hand, such children of pre-school age are generally able to discern simple words on sight and furthermore are able to compose simple sentences.

Prior art toy typewriters have generally been designed to simulate the keyboard and action of a conventional typewriter wherein each key has imprinted thereon a letter, such letter usually occupying the same position as the letter would occupy on a conventional typewriter. The type bar mechanism on such typewriters has usually been designed in a fashion similar to that of a conventional typewriter resulting in complicated lever and wire mechanisms connected between the key and the type arm with an attendant requirement for many springs. Generally on such typewriters a separate space bar is provided, again similar to a conventional typewriter, to permit the incrementing of the carriage a given space without imprinting on the paper. Due to the complexity of such toys and the requirement that a user be able to spell and have a certain amount of manual dexterity before full appreciation of the toy can be obtained, such toys have heretofore been unsuited for a child in its formative pre-school years.

Accordingly it is an object of the invention to provide a new and improved toy simulating a typewriter which enables a child to imprint a word on paper with a single key depression.

It is another object of this invention to provide a new and improved toy enabling a child to compose sentences of simple form.

It is another object of the invention to provide a toy simulating a typewriter wherein the spacing between words is accomplished without the need for an intervening operator manipulation.

SUMMARY OF THE INVENTION

The foregoing and other objects of the invention are accomplished by providing a toy simulating a typewriter with a movable carriage containing a platen for retaining paper thereon, and a keyboard having a plurality of keys, each key having inscribed thereon a preselected word from a limited vocabularly. A unitary type arm cluster is provided with a plurality of pivotable type arms, the free end of each type arm containing a removable pre-inked word-carrying type font pad, each type arm being selectively actuable by its corresponding key. A spacer frame is rockably mounted within the housing with a portion thereof beneath the keyboard, the portion beneath the keyboard being configured so that depression of any key rocks the spacer frame downwardly, the other end of the spacer frame having integral therewith an indexing projection coacting with an indexing bar carried by the carriage, the carriage being normally spring-biased in one direction.

The indexing bar and indexing projection are so configured that depression of a key imprints the corresponding word on the paper and release of the key permits the carriage to be incremented a predetermined distance to a position which permits the placing of another word on the paper with a spacing between words.

Other objects, features and advantages of the invention will become apparent upon a reading of the specification when taken in conjunction with the drawing.

DESCRIPTION OF THE PREFERRED EMBODIMENT

Figure 1:
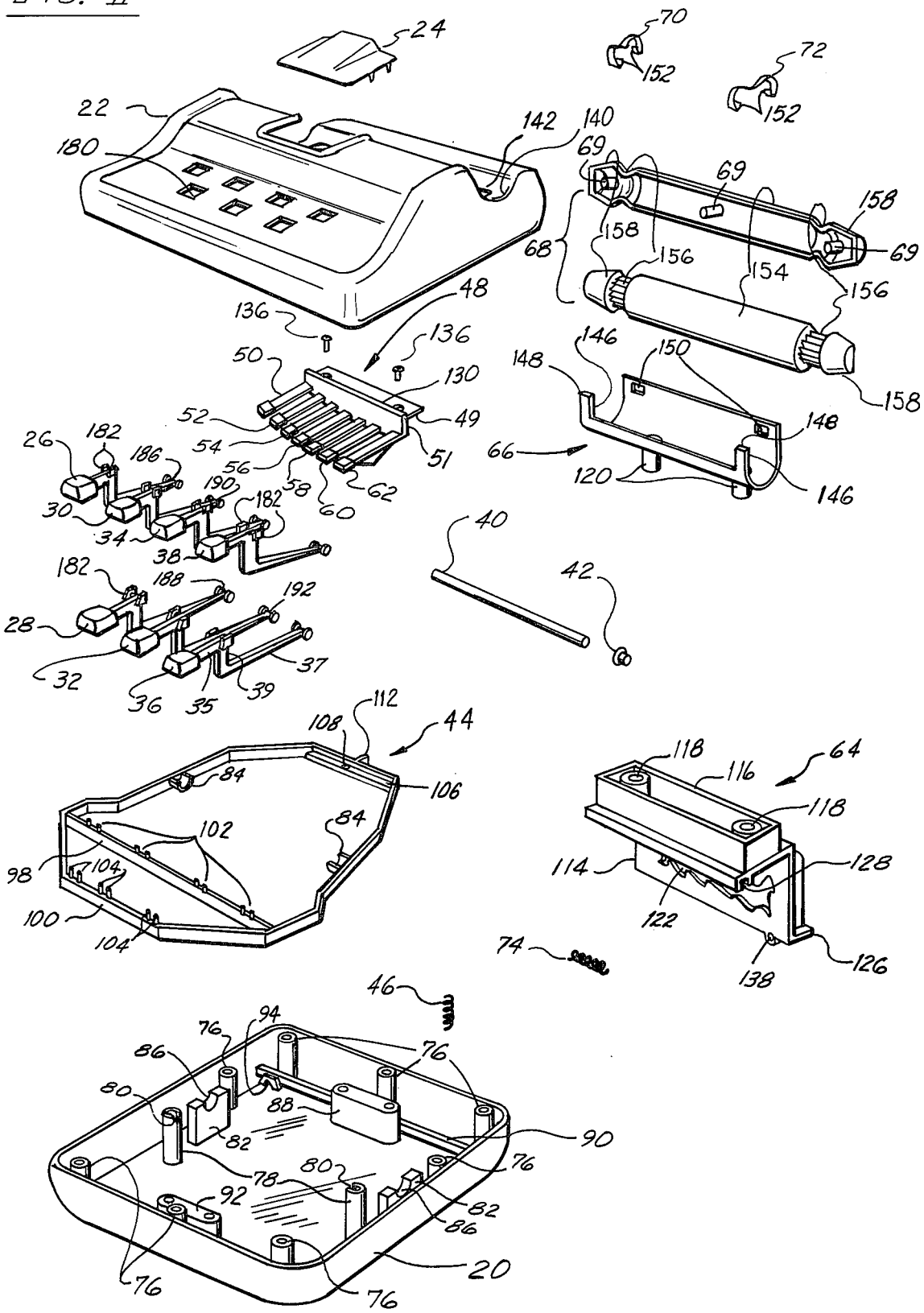
FIG. 1 is an exploded perspective view of a toy simulating a typewriter according to the invention.

Referring to the drawing and particularly to FIG. 1 there is shown a typewriter-like toy which includes a housing assembly having a lower housing portion 20, an upper housing portion 22 and a clear plastic shield 24. The keyboard assembly includes a first set of keys 26, 30, 34 and 38 and a second set of keys 28, 32 and 36, the first set of keys 26, 30, 34 and 38 being respectively the first or upper row with the second set of keys 28, 32 and 36 being the second or lower row. The keyboard assembly also includes a suitable shaft 40 with shaft fastening means 42 for pivotally securing the keys 26, 28, 30, 32, 34, 36 and 38 to the housing assembly.

Spacing means are provided and include a spacer frame, generally designated 44, and a spacer frame bias spring 46.

A unitary type arm cluster 48 is provided with a plurality of individually pivoted type arms 50, 52, 54, 56, 58, 60 and 62.

The carriage assembly includes the main carriage 64, an upper carriage or cradle 66, a roller or platen 68 (shown in two parts) and platen detenting clips 70 and 72. The carriage 64 is provided with a suitable coil return spring 74.

Structurally each of the housing portions 20 and 22 is a separate molded piece, preferably of plastic, with the lower housing portion 20 having molded integrally in the interior bottom surface thereof a plurality of attaching female bosses 76 adapted to have inserted therein and secured thereto suitable mating bosses 77 on the undersurface of upper housing portion 22. Also molded in the surface of bottom housing portion 20 are the following: a pair of upwardly extending keyboard shaft 40 retaining projections 78 having partially circular cutaway recesses 80 for retaining shaft 40; upwardly extending trunnions 82 rockably retaining spacer frame 44 by means of a pair of aligned inwardly extending pivot projections 84 resting in mating recesses 86 of trunnions 82; an elongate upwardly extending type arm cluster retaining portion 88 for receiving type arm cluster 48; and a transversely extending upwardly projecting guide rib 90 for coacting with a guide bar 126 of carriage 64 during transverse movement thereof. Also provided in the bottom surface of bottom housing portion 20 is a spacer frame limiting abutment 92 adjacent the front end thereof and a carriage spring retaining eyelet 94 adjacent the left end of guide rib 90.

Figure 2:
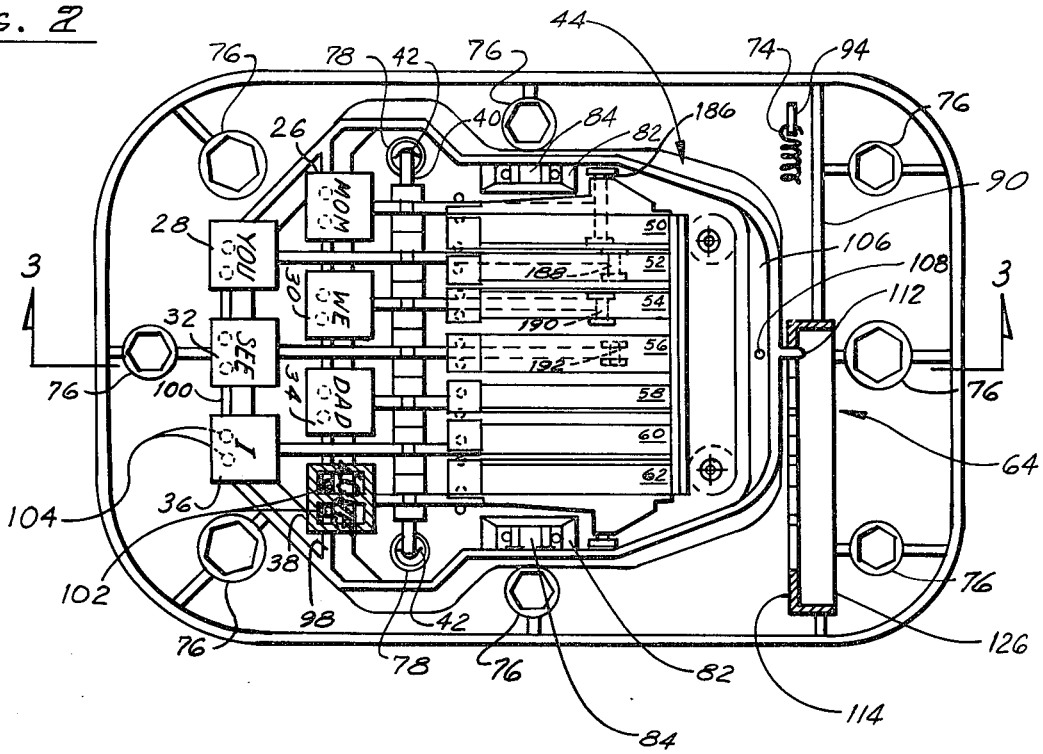
FIG. 2 is a plan view of the toy of FIG. 1, partially in cross section, with the top portion of the housing and the carriage mechanism removed.
Figure 3:
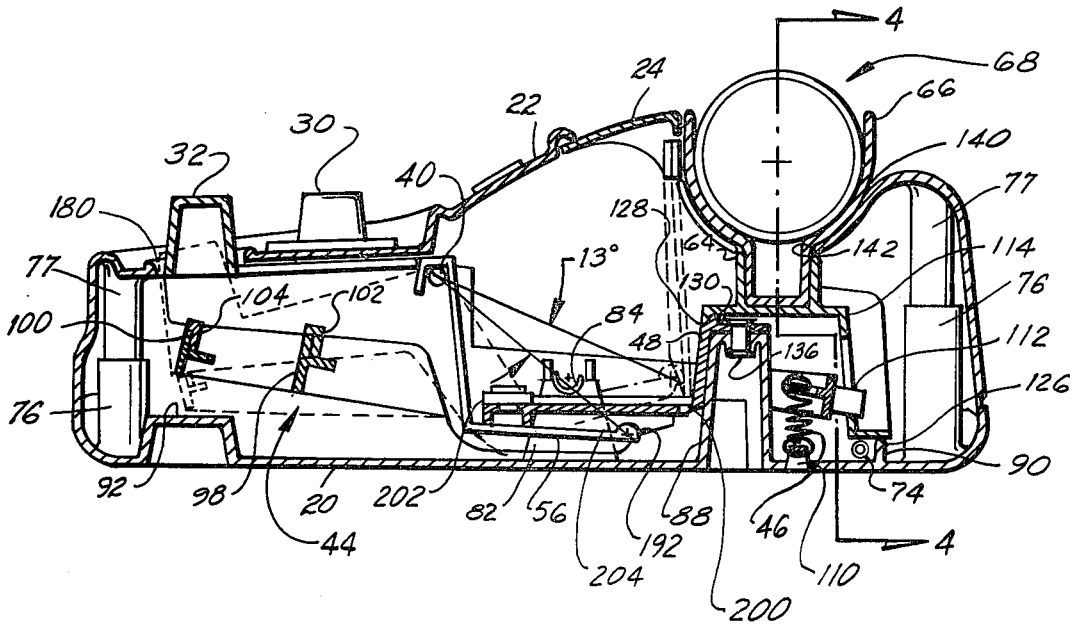
FIG. 3 is a cross-sectional view of the toy of FIG. 1 taken generally along line 3—3 of FIG. 2 showing, in dotted lines, positions of the moving parts.

The parts depicted in FIG. 1 are shown in assembled condition in FIGS. 2 and 3. As assembled, the spacer frame 44 is positioned in the lower housing portion 20 with the pivot projections 84 thereof resting in the recesses 86 of trunnions 82 for rocking or pivoting movement. As can be seen in FIGS. 1 and 2 the spacer frame 44 is an irregularly configured symmetrical (with respect to an axis transverse to the pivot axis) open generally ovate framework having first and second transversely extending bar members 98 and 100 in parallel relation, bar member 98 being adapted to coat with the first set of keys (keys 26, 30, 34 and 38) and bar member 100 is adapted to coact with the second set of keys (keys 28, 32 and 36). Bar member 98 has formed integrally in the upper edge thereof four pairs of upwardly extending pins 102, and similarly bar member 100 is provided with three such pairs of pins 104, the pins 102 and 104 being adapted to receive therebetween an arm of each of the key members 26, 28, 30, 32, 34, 36 and 38 as will hereinafter be described.

The bar member 100 which is the front edge of spacer frame 44 is positioned immediately above abutment 92 within lower housing portion 20 which limits the downward rocking movement of spacer frame 44 (see also FIG. 3). The opposite end of spacer frame 44 is generally bar-shaped and has a flange 106 with a centrally disposed aperture 108 therein for receiving the upper end of spacer frame rocker spring 46, the lower end thereof being secured to a suitable eyelet 110 (see FIG. 3) formed in the bottom of bottom housing portion 20. Extending rearwardly of spacer frame 44 adjacent aperture 108 and in a direction along the longitudinal axis of frame 44 is an indexing detent projection 112, the projection 112 being generally bar-shaped with the "bar" being positioned in a vertical direction.

The indexing detent projection 112 is adapted to coact with a lateral position indexing member 114 which is formed integrally with carriage 64. As best illustrated in FIG. 1 the carriage 64 is a generally inverted L-shaped member with an upwardly extending cradle receiving portion 116 having downwardly extending openings 118 formed integral therewith for receiving studs 120 of cradle 66 which are suitably secure therein. Downwardly extending from the rear portion of carriage 64 is the indexing member 114 which is generally bar-shaped with an irregularly configured opening 122 therein adapted to coact with indexing projection 112 on spacer frame 44. By referring also to FIG. 4 the configuration of the opening 122 is shown in relation to the indexing projection 112.

Returning again to the configuration of the carriage 64, extending rearwardly and generally flush with the lower edge of indexing member 114 is a planar guide bar 126 adapted to slidably engage guide rib 90 in the lower inner surface of lower housing portion 20. Also formed in carriage 64 is a guide groove 128 which has an inverted generally U-shaped cross section. The guide groove 128 is configured to slidably receive a guide rib 130 extending upwardly from the fastening end of type arm cluster 48.

Figure 4:
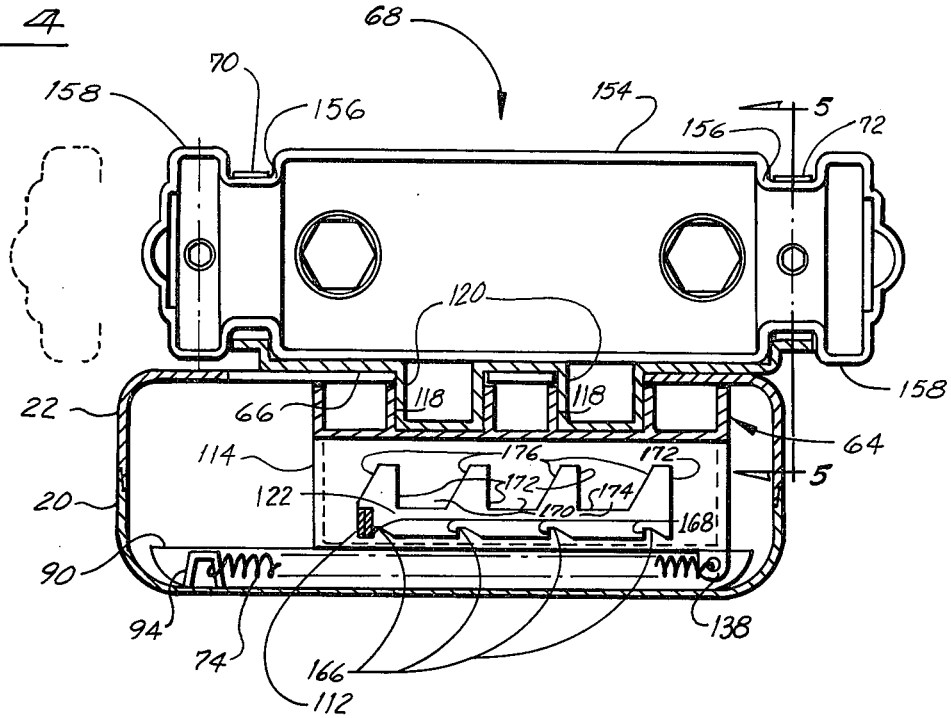
FIG. 4 is a cross-sectional view of the toy taken generally along line 4—4 of FIG. 3.

Referring to FIG. 3, and also FIG. 4 the carriage assembly in its assembled condition will be described. With the type arm cluster 48 secured by a suitable fastening means 136 to the type arm cluster retaining portion 88 the carriage 64 is positioned with guide rib 130 extending into guide groove 128 of carriage 64 while guide bar 126 of carriage 64 rests on guide rib 90 formed on the interior surface of bottom housing portion 20. The carriage indexing spring 74 (see FIG. 4) has one end thereof secured to eyelet 94 formed in the bottom of lower housing portion 20 with the other end thereof being secured to a downwardly depending eyelet 138 formed integrally with indexing member 114 of carriage 64, the spring 74 urging or biasing the carriage 64 to the left as viewed in FIG. 4. As shown in FIG. 3 additional guiding of the carriage 64 along with cradle 66 is effected by a trough 140 formed in the rear surface of upper housing portion 22 with a transversely extending slot 142 formed therein, the slot 142 being elongate and generally rectangular and of a lengthwise dimension sufficient to accomodate the full transverse travel of carriage 64. As can be seen the width of slot 142 is greater than the overall width of the cradle-receiving portion 116 of carriage 64 and has a dimension just slightly greater than the width of the upper edge of studs 120 formed in the bottom of cradle 66. In this manner, with cradle 66 inserted after top housing portion 22 has been assembled the upper edges of carriage 64 are in close sliding relation with the inner surface of top housing portion 22 on either longitudinal side of slot 142, thus maintaining carriage 64 in proper engagement with respective guide ribs 130 and 90.

The cradle 66 is suitably configured to receive roller or platen 68 therein, the main portion of cradle 66 having an arcuate shape of slightly larger diameter than that of the main body portion of platen 68. Upwardly extending from either front edge of cradle 66 are parallel arms 146, each having a spring receiving aperture 148. Rearwardly of each of the spring retaining apertures 148 is a second pair of spring retaining apertures 150 (see also FIG. 5) adapted to receive the reentrant free ends 152 of roller detenting clips 70 and 72.

Figure 5:
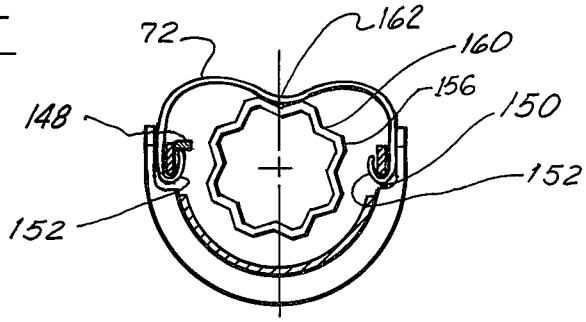
FIG. 5 is a cross-sectional view of the roller detenting means as viewed generally along line 5—5 of FIG. 4.

As shown in FIGS. 1 and 5 the platen 68 has a main platen portion 154 having reduced diameter serrated portions 156 on either side thereof with the roller or platen 68 terminating in knobs 158 at the opposite ends thereof. The platen 68 is formed of two substantially identical shell halves suitably secured by interconnecting pins 69 on the interior thereof. The serrated portion 156 is provided with eight generally V-shaped detents 160 configured to receive a correspondingly V-shaped central portion 162 of roller detenting clips 70 and 72 respectively. In conventional typewriter fashion the platen 68 can be rotated by grasping the knobs 158 and rotating platen 68 until the central portion 162 of detenting clip 72 is detented in an appropriate detent 160 of serrated portion 156 of platen 68. Although the paper to be used with the toy is not illustrated, as in a conventional typewriter carriage, referring to FIG. 3, the paper is inserted about the roller 68 from the rear where the paper is retained between platen portion 154 and the upwardly extending portion of cradle 66, the roller 68 then being rotated by means of knobs 158 clockwise until the paper appears between the upwardly extending arms 146 of cradle 66 in a position ready for typing.

Referring again to FIGS. 3 and 4 the carriage incrementing will be discussed briefly with respect to rocking of the spacer frame 44. As can be seen in FIG. 4 the carriage 64 is to the complete right with coil spring 74 fully stretched, this position of the carriage 64 being the initial position for the commencement of use of the typewriter-like toy. In this position the carriage 64 is retained in the right-most position by means of the indexing projection 112 abutting against the adjacent edge of a first sawtoothed projection 166 formed in the lower edge of opening 122 of indexing member 114. Indexing member 114 surrounding opening 122 is configured to index the carriage mechanism upon rocking of the spacer frame 44, the lower edge adjacent opening 122 being provided with four sawtooth projections 166 each having a perpendicular stop edge 168 on the lower edge adjacent opening 122, with each stop edge 168 being adapted to sequentially abut against indexing projection 112 as the carriage 64 is incremented from right to left as viewed in FIG. 4. The stop edges 168 are spaced equal distances and intermediate stop edges 168 the indexing member 114 has downwardly extending print positioning projections 170 having a vertical stop print edge 172 extending into opening 122. Each stop print edge 172 is displaced a predetermined distance to the right of lower stop edge 168 with each print positioning projection 170 being configured to have a downwardly extending stop print edge 172, a horizontally extending lower edge 174, and an upwardly sloping guide edge 176.

In operation, the spacer frame 44 rocks about a fixed pivot determined by pivot projections 84 resting in recesses 86 of trunnions 82 as a consequence of which indexing projection 112 traverses a fixed vertical path of travel within opening 122, the upper and lower ends of travel being defined by the uppermost and lowermost portions of indexing member 114 adjacent opening 122. As shown in FIG. 4 the indexing projection 112 is in its lowermost position and with spacer frame 44 rocked the indexing projection 112 will travel upwardly until the lower edge thereof clears the top of sawtooth projection 166 at which point the carriage 64 is pulled to the left under force of coil spring 74. However, indexing projection 112 is still travelling upwardly so that the upper edge thereof has at least a portion in the path of travel of the immediately following print positioning projection 170 until stop print edge 172 abuts against indexing projection 112. As will hereinafter be described, this indexing actuation results in the following sequence: (a) indexing projection 112 travels a distance to clear the stop edge 168 abutting thereagainst permitting carriage 64 to be advanced to the left a predetermined distance under control of coil spring 74; (b) the next succeeding stop print edge 172 abuts against upwardly rising indexing projection 112 thereby stopping further travel of carriage 64; (c) the selected type arm 50–62 is actuated thereby placing an imprint on the paper at a position corresponding to the selected position of the stop print edge 172, the indexing projection 112 still continuing in an upward direction of travel sliding against the abutting stop print edge 172; (d) with the imprint made and the selected key 26–38 released the indexing projection 112 commences its travel downwardly until the upper edge thereof clears the stop print edge 172 with indexing projection 112 in the space between adjacent sawtooth projections 166; (e) the selected type arm 50–62 is returning to its original position and the carriage 64 is incrementing to the left another predetermined distance, this distance being the distance between stop print edge 172 and the next stop edge 168 of the sawtooth projection 166 next in line. This sequence is then repeated until the last position wherein the indexing projection 112 is abutting against the right-hand vertical stop print edge 172 of opening 122, this corresponding to the fourth and final word position possible with the indexing member 114 configured with an opening 122 as shown. However, it is not intended that this be a limiting factor inasmuch as a greater or lesser number of positions can be similarly utilized in accordance with the invention.

The typing is accomplished by means of the keyboard assembly and type arm assembly which will now be discussed. The keyboard as best illustrated in FIG. 2 includes a first set or upper row of keys 26, 30, 34 and 38 and a second set or lower row of keys 28, 32 and 36 which will collectively be referred to as the first through seventh keys for reference purposes, each of which has a word from a limited preselected vocabulary imprinted thereon. For example the first key 26 has imprinted thereon "mom"; the second key 28 has imprinted thereon "you"; the third key 30 has imprinted thereon the word "we"; the fourth key 32 has imprinted thereon the word "see"; the fifth key 34 has imprinted thereon the word "dad"; the sixth key 36 has imprinted thereon the word "I"; and the seventh key 38 (shown in cross-section) has imprinted thereon the word "love" (shown in dotted lines). The words selected include two nouns, three pronouns and two verbs which are simple in sight and sound and generally readily identifiable by a child of tender years with a minimum vocabularly, the child generally being able to identify the words on sight and to pronounce them. By the utilization of this vocabularly a child can compose a large number of grammatically correct sentences with little training to thereby promote the educational development of the child as well as the amusement for the child.

Each key 26–38 coacts with one of the seven type arms 50–62 of type arm cluster 48, for example, key 26 coacts with type arm 50; second key 28 coacts with second type arm 52; third key 30 coacts with third type arm 54, etcetera.

Referring to FIG. 1 each key 26–38 has a generally Z-shaped configuration, for example key 36 with an upper arm 35 and a lower arm 37 with an interconnecting downwardly extending portion 39, the free ends of the upper arms having the enlarged key portions suitably inscribed with a word. The enlarged key portions are adapted to fit into mating apertures 180 formed in the keyboard surface of upper housing portion 22. At the intersection at the other end of the upper arms with the interconnecting portion each key 26–38 has a pair of aligned apertures, collectively designated 182 through which the shaft 40 is inserted with the first through seventh keys 26–38 having their apertures 182 in alignment to provide the assembled condition shown in FIG. 2 with the free ends of shaft 40 capped by suitable retaining means 42 and resting in recesses 80 in shaft bearing projections 78 formed within the inner lower surface of bottom housing portion 20. As can be seen in FIGS. 1 and 3 the upper arms of the first set or upper row of keys 26, 30, 34 and 38 (first, third, fifth and seventh keys) are shorter than the upper arms of the lower row (second, fourth and sixth) of keys 28, 32 and 36, with the parallel bar members 98 and 100 of spacer frame 44 immediately beneath the upper and lower rows of keys 26–38 respectively. The upper arms of each of the keys 26–38 is respectively retained between a corresponding pair of pins 102 and 104 upwardly extending from bar members 98 and 100 respectively. As can be seen in FIG. 3 with the spacer frame 44 assembled within the housing portion 20 the spacer bias coil spring 46 is urging spacer frame 44 clockwise about its pivot projection 84 thereby applying an upward or clockwise force to the keys 26–38 of the keyboard by means of bar members 98 and 100 abutting upwardly against the upper arms of the coacting keys 26–38. This position is indicated in solid lines in FIG. 3.

The lower arms of the keys 26–38 terminate at the free ends thereof in cam bearing portions, four of which are designated, in FIG. 2, by reference numerals 186, 188, 190 and 192, for the first through fourth keys 26, 28, 30 and 32 respectively. Since the configurations for the cam bearing portions of the fifth, sixth and seventh keys 34–38 will be mirror images of the third, second and first cam bearing portions 190, 188 and 186 respectively, specific details for the fifth through seventh keys 34–38 need not be discussed. Each of the cam bearing portions 186, 188, 190 and 192 is configured in a direction generally perpendicular to the direction of the lower arm to which it is attached, with the cam bearing portions of adjacent keys 26–38 being offset slightly from one another in a line parallel to the direction of travel of carriage 64. As best illustrated in FIG. 2 each of the cam bearing portions 186–192 has a different length, cam bearing portion 192 associated with the fourth key 32 having the least dimension in the transverse direction while cam bearing portion 186 associated with the first key 26 having the greatest dimension in the transverse direction, the lengths of each of the cam bearing portions 186–192 being predetermined in accordance with the lateral movement required of the coacting type arm 50–56 during its travel to a position in general vertical alignment with the longitudinal axis of the lower housing portion 20, this being the impact position of each of the type arms 50–56 with the paper on the platen 68.

Figure 6:
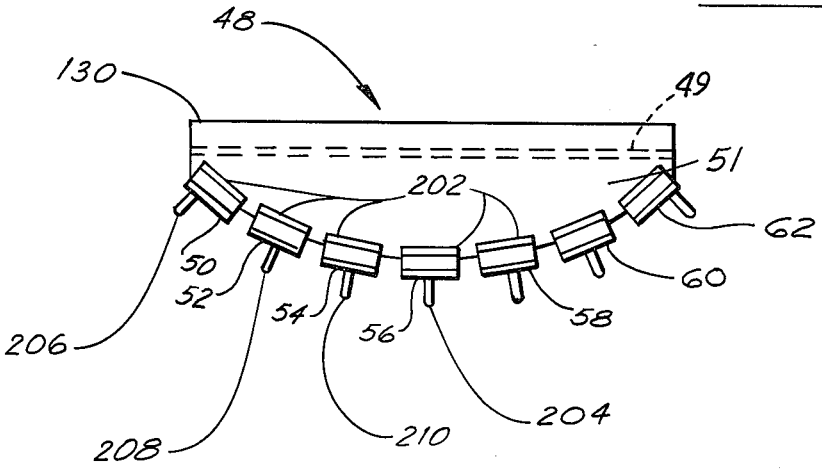
FIG. 6 is an end view of the unitary type arm cluster as viewed from left to right in FIG. 3.

The type arm cluster 48 is a unitary member having a generally inverted L-shaped fastening portion 49 with the downwardly depending arm 51 thereof being arcuately configured at the lower end as viewed in FIG. 6 with the type arms 50–62 extending transversely thereto and being secured thereto by an integral reduced cross section hinge portion 200 of the type referred to as a "living hinge". The hinge 200 is such that the type arms 50, 52, 54, 56, 58, 60 and 62 are normally biased downwardly or in a counter-clockwise direction as viewed in FIG. 3 to the solid line position of type arm 56, this being the type arm associated with the fourth key 32 positioned along the longitudinal center axis of the lower housing portion 20. The outer free end of type arm 56 (as well as each other type arm 50–62) has affixed thereto a pre-inked word-carrying type font pad 202 for reproducing the word "see" upon impact on paper. For convenience each type font pad will be collectively referred to by the reference numeral 202.

As best illustrated in FIG. 6 each of the type arms 50, 52, 54, 56, 58, 60 and 62 is positioned in an arcuate plane extending out from the paper so that upon pivotal movement thereof upon actuation of the respective key 26–38 the font pad 202 associated therewith will appear at generally the same location with respect to the vertical center of the type arm cluster 48, the vertical center being the "print" position generally perpendicular to the plane of the pad 202 of type arm 56, this being the center or fourth type arm of the type arm cluster 48. This, of course, would correspond to the imprint position on the paper. Due to the arcuate positioning of the type arms 50–62, the lower arms of the key members 26–38 would be suitably vertically displaced to provide proper engagement therewith.

Figure 8:
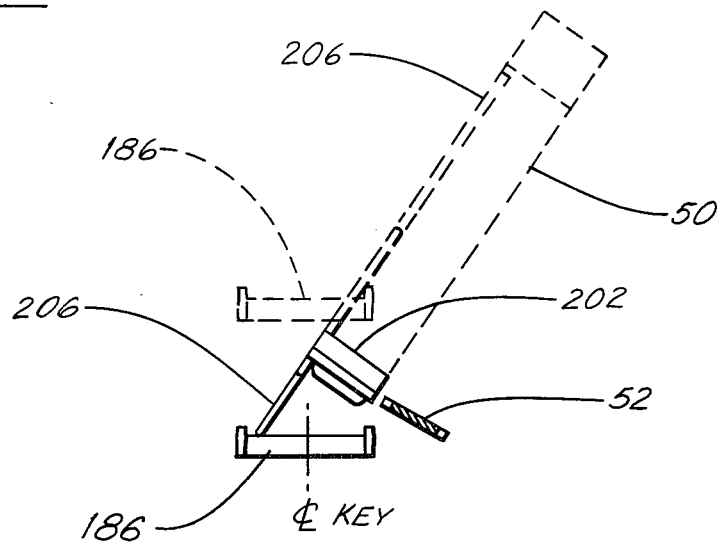
FIG. 8 is a diagramatic illustration of the first key in its unactuated condition (solid lines) and its actuated condition (dotted lines) as viewed from the left in FIG. 7, illustrating the positional relation between the cam rib on the type arm and the cam-bearing end of the typewriter key.
Figure 7:
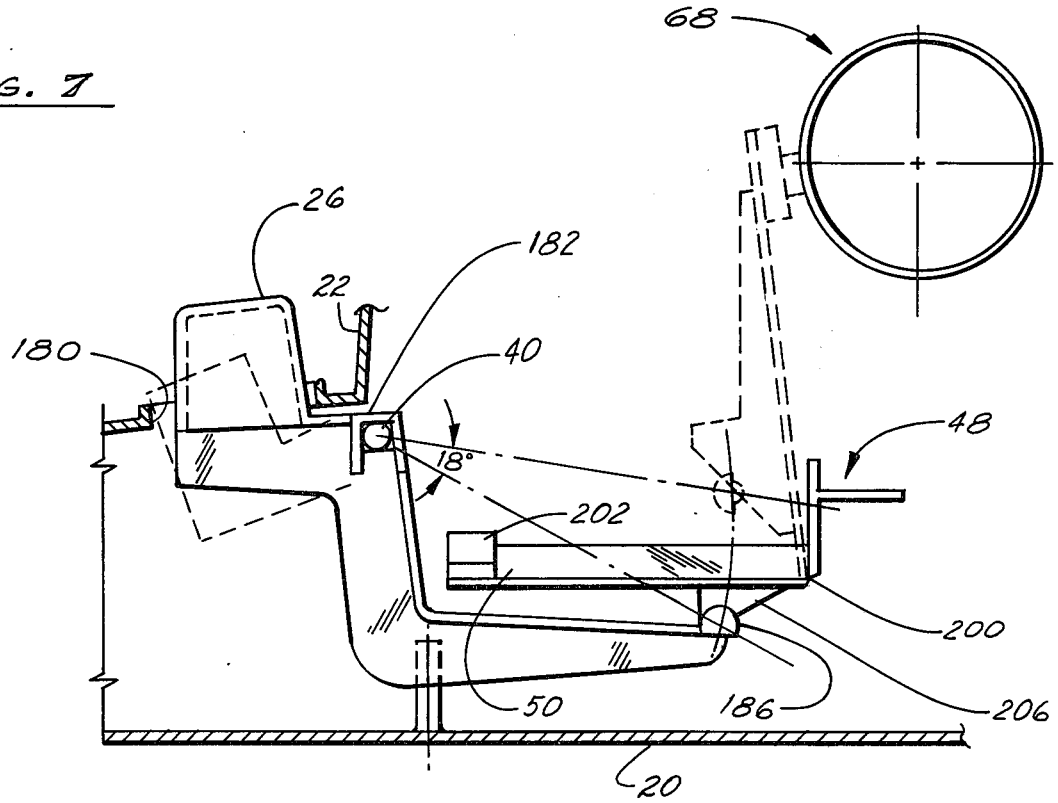
FIG. 7 is a diagramatic cross-sectional view illustrating the placement (solid lines) and operation (dotted lines) of the first and seventh keys of the keyboard.
Figure 9:
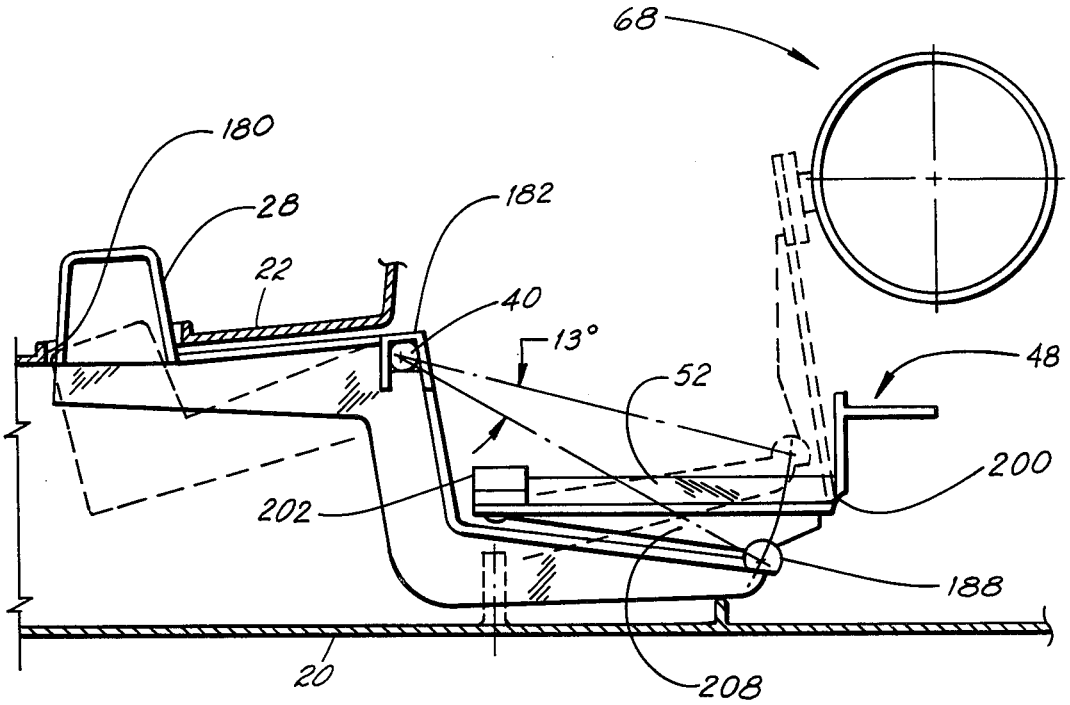
FIG. 9 is a diagramatic cross-sectional view illustrating the placement (solid lines) and operation (dotted lines) of the second and sixth keys of the keyboard.
Figure 10:
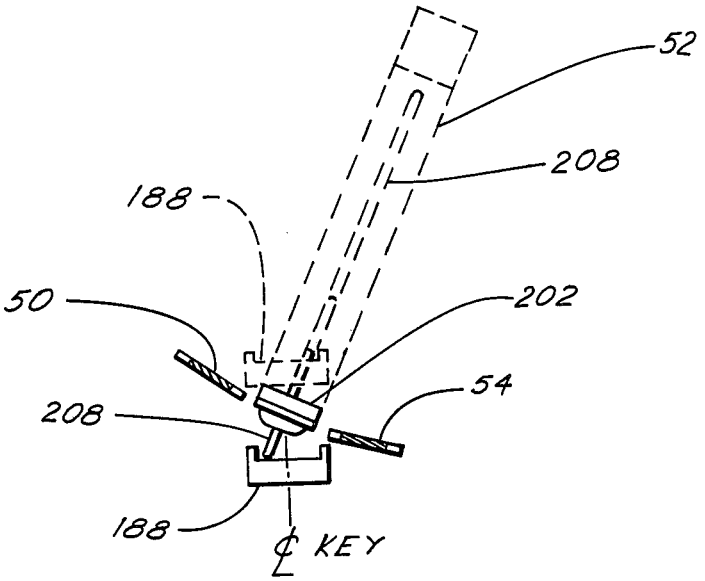
FIG. 10 is a diagramatic illustration of the second key in its unactuated condition (solid lines) and its actuated condition (dotted lines) as viewed from the left in FIG. 9, illustrating the positional relation between the cam rib on the type arm and the cam-bearing end of the typewriter key.
Figure 11:
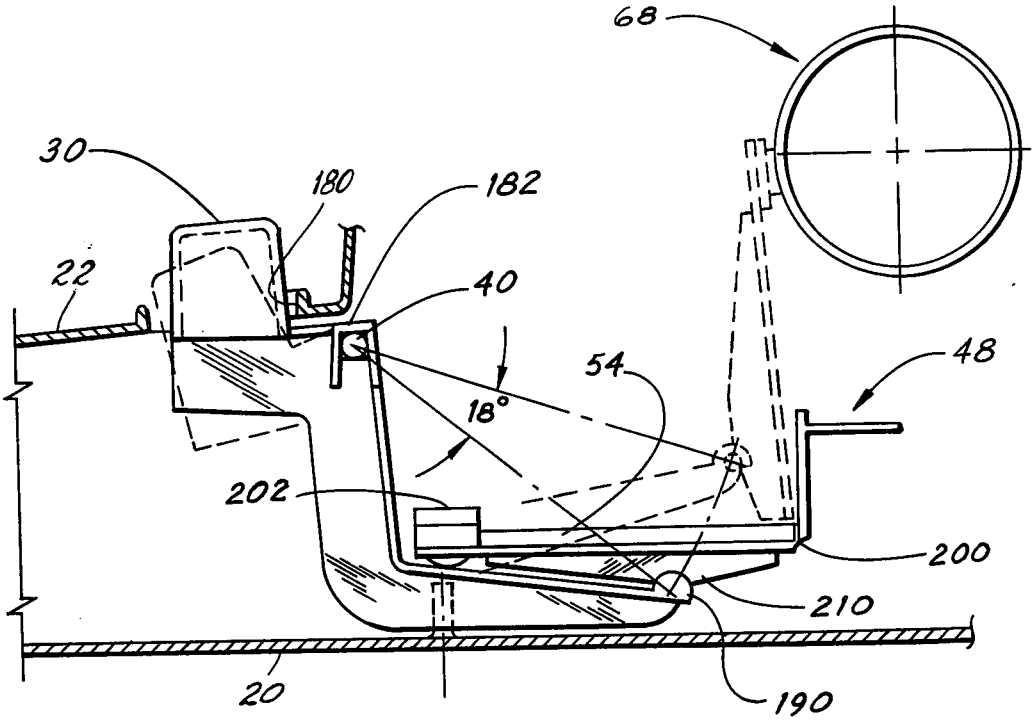
FIG. 11 is a diagramatic cross-sectional view illustrating the placement (solid lines) and operation (dotted lines) of the third and fifth keys of the keyboard.
Figure 12:
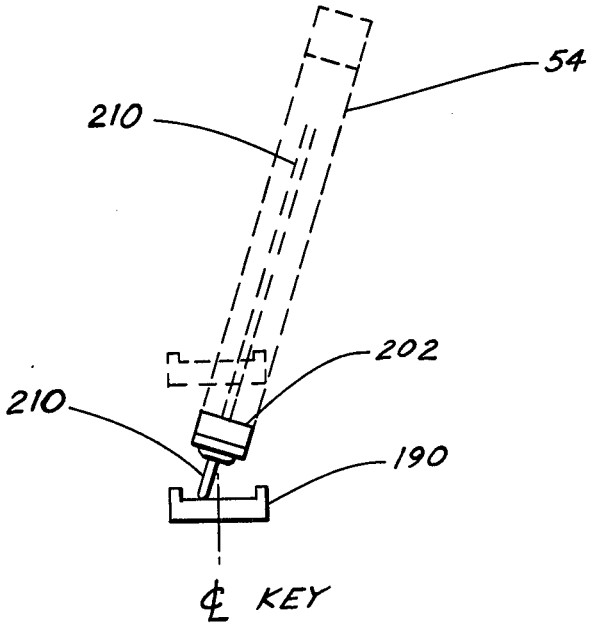
FIG. 12 is a diagramatic illustration of the third key in its unactuated condition (solid lines) and its actuated condition (dotted lines) as viewed from the left in FIG. 11, illustrating the positional relation between the cam rib on the type arm and the cam-bearing end of the typewriter key.

Referring again to FIG. 3 and FIGS. 7–12, the underside of each type arm 50–62 is provided with a perpendicular downwardly extending cam rib, cam rib 204 being connected to type arm 56; which in turn is associated with the fourth key 32 (FIG. 3). In FIGS. 7 and 8 the first key 26 is illustrated with its corresponding type arm 50 and cam rib designated 206. In FIGS. 9 and 10 the second key 28 is illustrated with its corresponding type arm 52 with its integral cam rib designated 208. In FIGS. 11 and 12, similarly, the third key 30 is illustrated with its corresponding type arm 54 with its integral cam rib designated by the reference numral 210.

The operation of the various keys 26–38 are illustrated in FIGS. 3 and 7–12 wherein the solid line positions of the keys 26–38 and the type arms 50–62 illustrate the normal non-depressed condition while the dotted lines for the keys 26–38 and the type arms 50–62 indicate the depressed fully operated position of the keys 26–38 with the corresponding rotation of the type arms 50–62 to the imprint position with the pad 202 imprinting on the paper (not shown). In FIGS. 7, 9 and 11 which are generally side views of the respective keys 26–38, only the keys 26–38, the type arm 50–62 and the roller position are designated with the spacer frame 44 and other mechanical details being eliminated for the purpose of clarity. FIGS. 8, 10 and 12 illustrate, in solid lines, the normal position of the type arm 50–62 with respect to the fully lowered position of its corresponding cam bearing portion 186–192 of the associated key 26–38, with the dotted line position therein indicating the fully actuated position of the cam bearing portion 186–192 to raise the type arm 50–62 to the position indicated. The views of FIGS. 8, 10 and 12 would be views looking from left to right in FIGS. 7, 9 and 11 respectively.

Referring now to FIG. 3 operation of the fourth key 32 will be discussed in detail. The normal solid line position illustrates the key 32 in its normal position pivotally mounted about shaft 40 with the cam bearing portion 192 at the outer free end of the lower arm thereof receiving between opposing flanges thereof the cam rib 204 of type arm 56. In this position the hinge 200 of type arm cluster 48 resiliently biases type arm 56 to the solid line position shown. In this position also, pins 104 upwardly extending from bar member 100 of spacer frame 44 are on either side of the upper arm of key 32, pins 104 acting as guide pins during travel of the key 32. Additionally, transverse bar member 100 abuts against the under edge of the upper arm of key 32 due to the downwardly extending force of coil spring 46 attached to the other end of spacer frame 44. As the operator depresses key 32 spacer frame 44 is simultaneously pivoted counterclockwise about its pivot 84 resting in trunnions 82. This action rotates key 32 in a counterclockwise direction thereby elevating cam bearing portion 192 which in turn pivots type arm 56 in a clockwise direction to the position illustrated in dotted lines whereupon the type pad 202 impacts against the paper carried on platen 68. The total angle of travel of cam bearing portion 192 about pivot shaft 40 is shown as being 13°. For this particular key 32 which is the cenrally located key of the keyboard the cam rib 204 is centrally disposed with respect to the longitudinal axis of type arm 56 and as shown in FIG. 2 the distance between opposing flange ends of cam bearing portion 192 is slightly greater than the width of cam rib 204.

FIGS. 7 and 8 illustrate the movement, configuration and location of the first key 26, it being understood that this would also apply to the seventh key 38 which occupies the same distance from the longitudinal center line of the middle or fourth key 32. As shown in FIG. 7 the first key 26 has a short upper arm which, coupled with the location of type arm 50 on cluster 48, requires a larger degree of angular pivoting, this being designated as 18° which is the angle between the dot-dash lines on either side thereof. The cam rib 206 extends outwardly from the surface of type arm 50 which is adjacent the outer edge of the type arm cluster 48. As illustrated in FIG. 8 the cam rib 206 is positioned along the left edge of type arm 50 since type arm 50 has to travel a greater lateral distance from the outer edge of type arm cluster 48 to centrally located imprint position with respect to roller 68. To accomodate this lateral travel cam bearing portion 186 has a transverse dimension between opposing flanges thereof which is sufficiently large to permit this lateral travel from the left end thereof in the normal position of type arm 50 to the right edge thereof with the cam bearing portion 186 in its fully actuated position as indicated in dotted lines with the flange thereof abutting against the right side of cam rib 206 thereby fully guiding cam rib 206 during the typing operation laterally between opposite flanges of cam bearing portion 186. The fully actuated position is shown in dotted lines in FIG. 7 with the type arm 50 in its imprint position and key 26 fully depressed.

FIG. 9 illustrates the unactuated position of the second key 28 with its cam bearing portion 188 having resting between opposing flanges thereof the cam rib 208 of type arm 52. As can be seen in the dotted line "imprint" fully actuated position the cam rib 208 is configured somewhat differently in order to accommodate the amount of angular travel of 13° of rotation of key 28 which, similar to the fourth key 32, has a long upper arm. As can be seen in FIG. 10 the cam rib 208 is centrally disposed with respect to the under surface of type arm 52 and the cam bearing portion 188 has a length sufficient to accommodate the lateral travel of type arm 52 during operation thereof. The illustration of FIG. 9 would likewise correspond to the operation of the sixth key 36 since it is spaced an equal distance from the center key 32 on the opposite side thereof. FIG. 10 would likewise, in mirror image, correspond to the elevated position of the type arm 60 of the sixth key 36.

FIG. 11 illustrates the operation of the third key 30 which has a short upper arm (and correspondingly, the fifth key 34) wherein the angle of travel requires 18° and the cam rib 210 coacting with cam bearing portion 190 is configured to accommodate the amount of travel required upon depression of key 30 to its dotted line position thereby raising type arm 54 to the dotted line imprint position indicated. Correspondingly, FIG. 12 illustrates the cam rib 210 being centrally disposed with respect to the under surface of type arm 54 and cam bearing portion 190 having a dimension between opposing flanges thereof sufficient to accommodate the lateral travel of type arm 54 with cam rib 210 slidably engaging cam bearing portion 190 during actuation thereof.

Each of the pre-inked word-carrying type font pads 202 has the raised font embossed thereon in mirror image and in an angular position such that, when imprinted on paper, the words will appear along a horizontal line. Additionally, in order to obviate the necessity for a child of tender years to effect a spearate spacing operation, the type font pad 202 is so configured and the indexing mechanism is so-dimensioned that successive typing of two words results in a space therebetween without the need for a spearate spacing operation as required in a conventional typewriter.

Although the type font pads 202 can be made removable for inking or configured to permit re-inking without removing, in the preferred embodiment the type font pads 202 are pre-inked so that multiple impressions can be effected without the necessity for inking by the child. Due to the construction of the type font pads 202 the clear plastic shield 24 is attached to the upper housing 22 to preclude contact by the child with the pads 202.

Self-inking print elements are known in the prior art and may include for example self-inking rubber of the type referred to in IBM Technical Disclosure Bulletin, Vol. 11 No. 11, Apr., 1969, or by means of a porous coating as referred to in IBM Technical Disclosure Bulletin, Vol. 15 No. 4, Sept., 1972. In the embodiment illustrated the self-inking type font pads 202 is accomplished by utilizing a basic plastisol mixture to which is added a colored dye, such as black dye, with suitable carriers, the mixture being used to form the type font pads 202 to provide the self-inking for the words to be imprinted on paper.

Accordingly, the typewriter-like device according to the invention is essentially a "word writer" which enables a child of tender years to compose many correct sentences with spacing between words accomplished without an additional operator step by means of the placement of the characters on the type font pads 202 with the word spacing being provided at either or both ends of the word. Indexing of the carriage 64 is positive and requires few moving parts. The type arm cluster 48 is a unitary member having a living hinge 200 providing the necessary pivotal movement of the type arms 50–62 while also providing the necessary bias to return the type arms 50–62 to the normal unactuated position. Word selection is from a limited vocabularly readily identifiable by a child of tender years, the words selected, although few in number, enabling a child to compose many sentences which are grammatically correct and have significance to a child of tender years. The unit approximates twenty-five components in total, including fastening means and springs, thus providing relatively sophisticated operation in a relatively uncomplicated manner. Although not shown each row of keys 26–38 is made from one mold with a sprue thereof being removed prior to assembly.

While there has been shown and described a preferred embodiment it is to be understood that various other adaptations and modifications may be made within the spirit and scope of the invention.

What is claimed is:

1. In a toy typewriter-like instrument, the combination comprising:

a housing;

a platen for receiving paper thereon, said platen being mounted on a carriage for movement on said housing to move the paper past a print position;

a plurality of pivotable type arms mounted within said housing, each of said type arms having pads affixed to the free ends thereof with each of said pads having a type font thereon to imprint a different word of a pre-selected vocabulary;

a plurality of key members pivotally mounted within said housing to form two rows of keys, each of said key members coacting with a predetermined one of said type arms, the key member for a given type arm having a portion thereon carrying indicia corresponding to the word on the pad of said type arm, said type arms and said key members being configured to operate each of said pads to said print position in response to actuation of said keys;

a spacer frame rockably received within said housing about a pivot axis, one end of said spacer frame having a bar member portion disposed beneath each of said rows of said keys, each of said bar member portions extending in a line generally parallel to the pivot axis of said spacer frame;

an indexing projection on the end of said spacer frame opposite said bar member portions;

a downwardly extending indexing member on said carriage with an opening therein, the periphery of said opening being configured to receive said projection therein; and edge means within said opening for coacting with said projection to increment said carriage a predetermined distance in response to pivoting of said spacer frame.

2. The combination according to claim 1 wherein said bar member portions have a plurality or pairs of upwardly extending projections, each of said pair of projections receiving a portion of a key member therebetween whereby to guide said key members during actuation thereof.

3. The combination according to claim 2 wherein said indexing member is configured adjacent the opening thereof to form a lower row of upwardly extending sawtooth projections and an upper row of downwardly extending projections intermediate said sawtooth projections, the indexing member projections being so configured that movement of said indexing projection against the force of the bias spring increments said carriage a portion of said predetermined distance and the movement of said indexing projection under force of its bias spring increments said carriage the remaining portion of said predetermined distance.

4. In a toy typewriter-like instrument, the combination comprising:

a housing;

a platen for receiving paper thereon, said platen being mounted for movement on said housing to move the paper past a print position;

a unitary type arm cluster having a main portion secured within said housing, said main portion having a generally planar surface with an arcuate periphery with a plurality of type arms hingedly secured to said periphery by means of a reduced cross section hinge portion integral with said main portion, each of said type arms being normally operatively disposed in a direction transverse to the plane of said surface, the free ends of each of said type arms having a type font carrying pad affixed thereto;

a plurality of key members, each of said key members pivoting one of said type arms to move the pad thereof to said print position; and means for incrementing said platen in response to actuation of any one of said key members.

5. The combination according to claim 4 wherein said print position is fixed with respect to said cluster and each of said type arms is pivotable with the pad thereon at said print position.

6. The combination according to claim 5 wherein each of said type arms has a cam rib extending transversely thereto on the under surface thereof and each of said key members has a cam bearing portion coacting with its respective cam rib to pivot said type arms.

7. The combination according to claim 6 wherein each of said key members is pivotally mounted within said housing about a pivot axis and has a lower arm with said cam bearing portion at the free end thereof.

8. The combination according to claim 7 wherein each of said key members has an upper arm extending out from the pivot axis thereof in a direction opposite to said lower arm, said upper arm having an enlarged portion at the free end thereof having indicia thereon corresponding to the type font on the pad of its respective type arm.

9. The combination according to claim 8 wherein the indicia of each of said enlarged portions is a word and the type font on said pad is configured for imprinting that word.

10. The combination according to claim 9 wherein each of said pads is pre-inked.

* * * * *